United States Patent [19]

Gasnier et al.

[11] Patent Number: 4,616,118

[45] Date of Patent: Oct. 7, 1986

[54] COCK AND TRIP SWITCH ACTUATING MECHANISM

[75] Inventors: Robert Gasnier, Bixby; Larry N. Wolfenbarger, Tulsa, both of Okla.

[73] Assignee: General Signal Corporation, Stamford, Conn.

[21] Appl. No.: 820,583

[22] Filed: Jan. 21, 1986

Related U.S. Application Data

[63] Continuation of Ser. No. 622,260, Jun. 19, 1984, abandoned.

[51] Int. Cl.[4] ..... H01H 3/30

[52] U.S. Cl. ..... 200/153 SC; 200/63 R; 200/321

[58] Field of Search ..... 200/153 SC, 321, 63 R, 200/70

[56] References Cited

U.S. PATENT DOCUMENTS 3,919,512 11/1975 Ray ..... 200/70

4,095,065 6/1978 Akers ..... 200/63 R

*Primary Examiner*—Stephen Marcus

*Assistant Examiner*—Renee S. Luebke

*Attorney, Agent, or Firm*—Milton E. Kleinman; Robert Hubbard

[57] ABSTRACT

A cock and trip switch actuating mechanism for operating a switch inside of a housing, the switch having an energy storage system rotatably mounting on the housing wall and having a cam plate rotatable about a shaft extending perpendicularly of the housing wall, the cam plate having spaced apart notches in the peripheral edge, a switch carriage secured to and moved by the rotatable energy storage plate between switch positions, and a latch mounted on a housing wall juxtaposed to the energy storage mechanism and having a shaft extending through the housing wall, the latch having a reciprocal member which extends to engage a notch in the cam plate to prevent the rotation thereof, the reciprocal member being withdrawn by the rotation of the latching member shaft to permit the plate to rotate in response to energy storage in the springs. An operator utilizes the device by turning a cocking lever to apply mechanical spring force to the energy storage apparatus and then subsequently actuates the trip mechanism which can be done from a remote location.

9 Claims, 11 Drawing Figures

COCK AND TRIP SWITCH ACTUATING MECHANISM

This is a continuation application of Ser. No. 622,260, filed June 19, 1984 now abandoned.

BRIEF SUMMARY OF THE INVENTION

A type of switch gear commonly employed for high current loads is the oil-type which functions within a housing filled with oil. While the present invention is equally applicable to switching mechanisms whether or not of the oil type, it will be illustrated and described as it relates to an oil-type switch. The switch mechanism is contained within a housing and includes two shafts extending from the interior to the exterior of the housing, one for cocking the switching mechanism and the other for actuation of the switch. By means of an energy storage mechanism a cocking lever can be manually rotated to apply force to springs which, upon release, quickly move the switch from one position to another.

When fault conditions exist in a circuit connected to a switch, the actuation of the switch can cause an explosion in other devices located adjacent the switch, such as in the same vault where the switch is located. For this reason it is desireable, from a safety viewpoint, to be able to remotely actuate the switch. The present invention is directed towards a means of providing an arrangement wherein an operator can remotely actuate a switch with a minimal amount of effort while the switch itself, upon actuation, rapidly moves from one condition to another.

When switchgear is placed in a confined location, such as in an underground vault or other area where an explosion would be particularly dangerous to an operator standing in the vault it is particularly important that means be provided so that the switch can be operated remotely.

The switch housing includes a front wall. Mounted internally of the wall is the switching mechanism which can be in the form of a switch carriage connected to an actuating mechanism. The actuating mechanism includes energy storage means in the form of springs which are stretched as the energy storage mechanism is placed in a cocked position. In this manner, the energy storage mechanism can be preloaded with spring powered mechanical energy so that upon release the switch carriage is quickly moved from one switch position to another. The energy storage mechanism includes spaced apart plates having the springs between them. Affixed to the plates is a cam plate having a notched surface. A latching mechanism is mounted on the housing wall adjacent to the switch energy storage mechanism. A tripping shaft extends from the latching mechanism and perpendicularly through the housing wall. A reciprocal member extends from the latching mechanism to engage the notched surface in the cam plate. The reciprocal member prevents the cam plate, and thereby the energy storage mechanism, from rotating while in engagement with a notch in the cam plate surface, but upon rotation of the tripping shaft the reciprocal member is withdrawn from engagement with the cam plate, allowing it to rotate to thereby move the switch carriage from one switch position to another.

A trip lever is affixed to the tripping shaft. A lanyard can be affixed to the end of the trip lever so that the operator can cause the trip lever and thereby the tripping shaft to be rotated from a remote location.

DESCRIPTION OF THE PREFERRED EMBODIMENT

Figure 1:
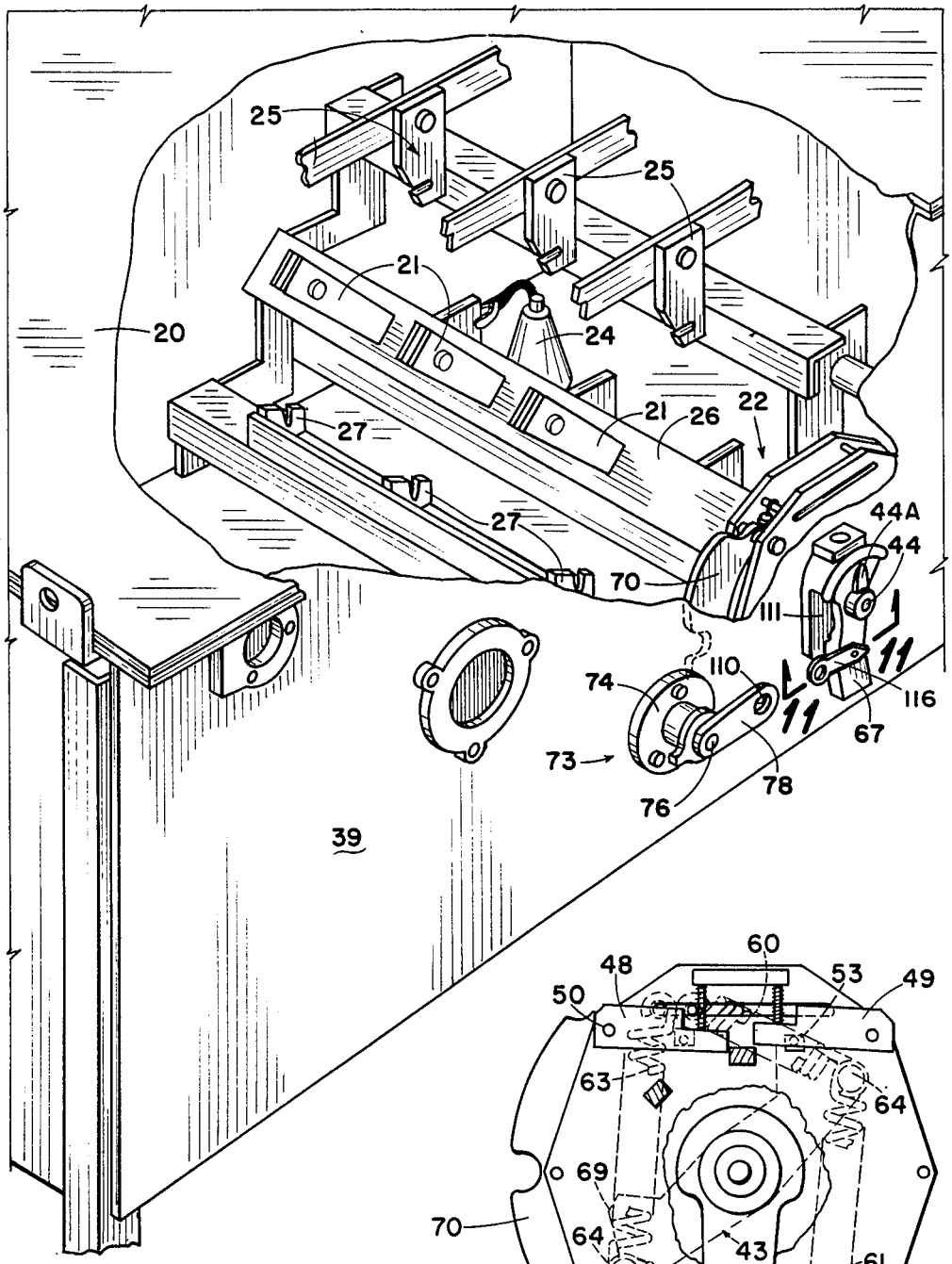
FIG. 1 is an external isometric view, partially cut away to show the interior thereof, of a load breaker oil switch and showing the cock and trip features of this invention.

Referring to the drawings and first to FIG. 1, a switch enclosure 20 is of the type which is filled with insulating oil. Switch blades 21 are operated by a stored energy operating assembly indicated generally as 22. Switch blades 21 can be connected through electrical bushing connections 24, only one of which is shown. Contact members 25 can be connected in the usual manner to insulator bushings (not shown) by which conductors are extended exteriorally of the housing 20.

The switch shown in FIG. 1 is a three-position switch. In the position illustrated the switch is in the OFF position. The switch blades 21 are connected to a carriage 26 by which they are moved, the carriage in turn being connected to the stored energy mechanism 22. When the carriage 26 is moved in the right-hand or clockwise direction by the stored energy mechanism, contact is made between switch blades 21 and contact members 25. This is the "ON" position. When the carriage 26 is rotated in the opposite left-hand or counterclockwise direction, the switch blades engage contact members 27 which may be connected to ground or may be connected to a test conductor system having conductors which are not fully rated but which will permit measurements of the system. This is the "TEST" position. Most high current switches are only two-position; that is, "ON" or "OFF". The present invention applies equally as well to such systems, but the invention is described herein to show how the mechanism can be employed for a three-position switch.

Figure 4:
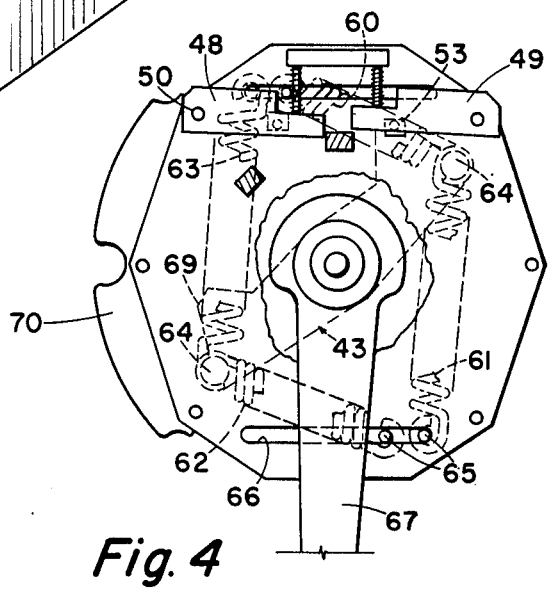
FIG. 4 is a front view of the energy storage mechanism of FIG. 2 showing, in reduced scale, the switch in a position wherein it is cocked and set and can be actuated by the latching mechanism.
Figure 2:
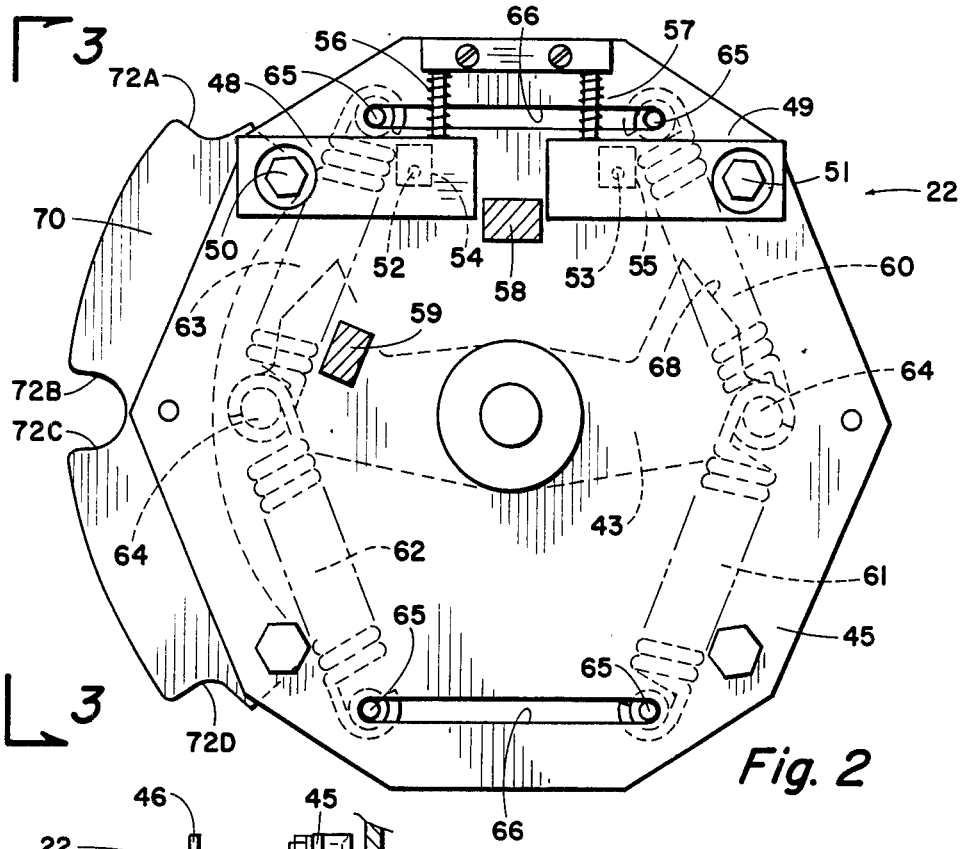
FIG. 2 is an end view of the energy storage mechanism as employed in actuation of the switch.
Figure 3:
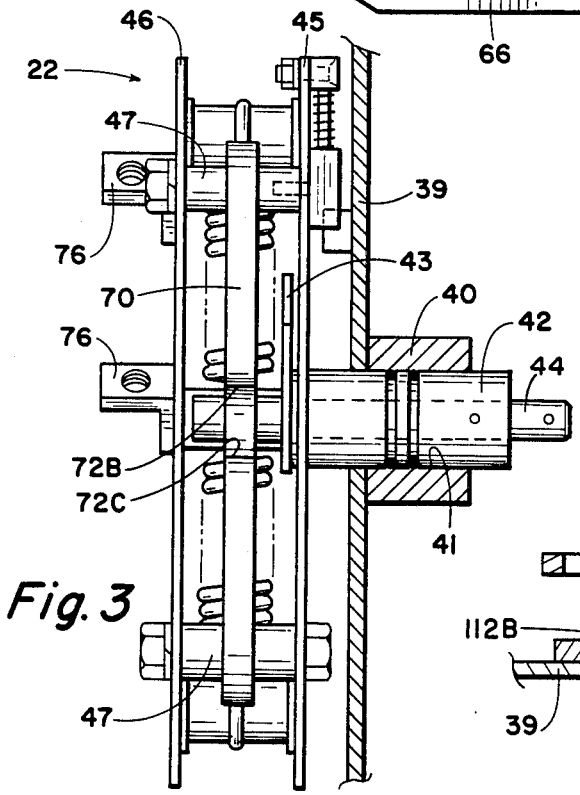
FIG. 3 is a front elevational view of the energy storage mechanism as shown supported to the front wall of the switch housing.

Referring to FIGS. 2, 3 and 4, front wall 39 of enclosure 20 has hub 40 thereon which provides journal 41 for receiving the bored or apertured shaft 42 which is connected to spring arm 43. Received within the bore of shaft 42 is the stored energy operating assembly shaft 44.

The stored energy operating assembly includes plates 45 and 46 which are held in spaced relation by spacers 47. Mounted on plate 45 are latching dogs 48, 49 which are pivotally supported on pivot pins 50, 51. The dogs have rearwarding extending pins 52, 53 (FIG. 2) which are arranged in apertures 54, 55 so that the dogs can be pivoted about the pivot pins 50, 51.

Dog springs 56,57 normally hold the dogs in a latching position relative to lugs 58,59. Lugs 58,59 are stationary and can be carried on front cover plate 39 of enclosure 20. Stored energy springs 60, 61, 62, and 63 are carried between the plates 45 and 46. Mating ends of springs 60, 61 and springs 62, 63 are carried on pins 64 mounted on each end of spring arm 43. The outer ends of the springs are mounted on pins 65 which are slidably carried in slots 66 in plates 45, 46, such being arranged so that the pins can slide in slots 66 as the springs are compressed by movement of arm 43.

Switch operating lever or handle 67 is fastened to the spring arm shaft 42. A pointer 44A (FIG. 1) can be mounted on shaft 44 so as to indicate the position of the assembly and the switch blades.

The switch blades are fastened to carriage 26 which in turn is connected to brackets 76 on end plate 46. The center of rotation of the switch blades is the center of rotation of the stored energy spring assembly so that rotation of the assembly will cause movement of the blades relative to the fixed contacts 25 and 27.

The switch is shown in its "open" position. As operating arm or handle 67 is moved counterclockwise, spring arm 43 will be rotated so that springs 61 and 63 are stretched, the plates 45 and 46 being held by latching dog 49 and lug 58 from rotation. The other ends of springs 60 and 62 will slide in the slots 66 as the springs tend to be compressed or not stretched. Thus, energy will commenced to be stored in the stored energy spring mechanism.

Continued rotation of switch operating arm 67, as seen in FIG. 4, will further stretch the springs until the cam surface 68 of spring arm 43 contacts pin 53 of dog 49. As a result, the stored energy assembly 22 is now released from being held by lug 58 so that it will tend to snap counterclockwise. As a result, the energized springs can rapidly rotate the stored energy operating assembly so that switch blade 21 will be snapped into closed position on switch contact members 25.

Thus it is seen how the stored energy mechanism 22 can cause a snap action of switch carriage 26 as handle 67 is rotated. The mechanism illustrated in FIGS. 2, 3 and 4 is essentially that which is disclosed in U.S. Pat. No. 3,919,512 issued Nov. 11, 1975 and entitled "Spring Actuated Electric Switch With Particular Latching Dog Arrangement". However, as previously stated, it may be desireable that the operator not be adjacent to the switch at the time of actuation. For this purpose, the present disclosure provides a unique trip mechanism. To adapt the energy storage means 22 to utilization of a trip mechanism, a cam plate 70 is secured to plates 45 and 46 by means of the bolts and spacers employed to hold the plates together. Cam plate 70 is positioned intermediate cam plates 45 and 46 and extends beyond the peripheries thereof. The cam plate has notched surfaces 72 identified by 72A through 72D.

Mounted on the switch front wall 39 is a tripping or latching mechanism generally indicated by the numeral 73. As shown in FIG. 1, the latching mechanism includes a hub 74 which receives a shaft 76 having a trip lever 78 affixed to it.

Figure 7:
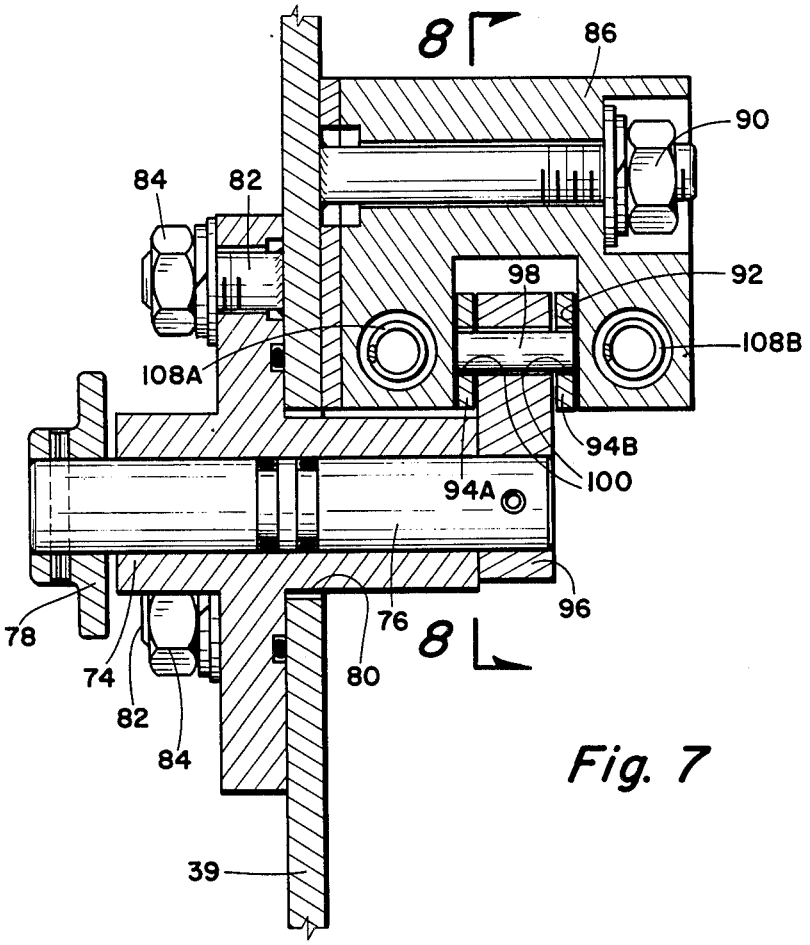
FIG. 7 is a cross-sectional view of the latching mechanism taken along the line 7—7 of FIG. 5.

As seen in FIG. 7, the hub 74 has a rearwardly extending portion which is received in an opening 80 in the switch front wall 39. Three studs 82 are welded to the front wall and are received in spaced openings in the hub 74 by which it is secured to the switch front wall 39. Nuts 84 hold the hub in position.

Mounted on the interior of front wall 39 is a carriage block 86 which is supported by two studs 88 welded to the interior of wall 39, the studs receiving nuts 90.

Carriage block 86 has a slot 92 which slidably receives a plunger which is in the form of two spaced apart plate members 94A and 94B. A crank arm 96 is secured to the inner end of the shaft 76, the outer end of the crank arm receiving a pin 98. Slots 100 (See FIG. 8) in the inner ends of each of the plungers 94A and 94B slidably receive pin 98.

At the outer end of plunger 94A, 94B is a shaft 102 which receives a roller 104.

Figure 6:
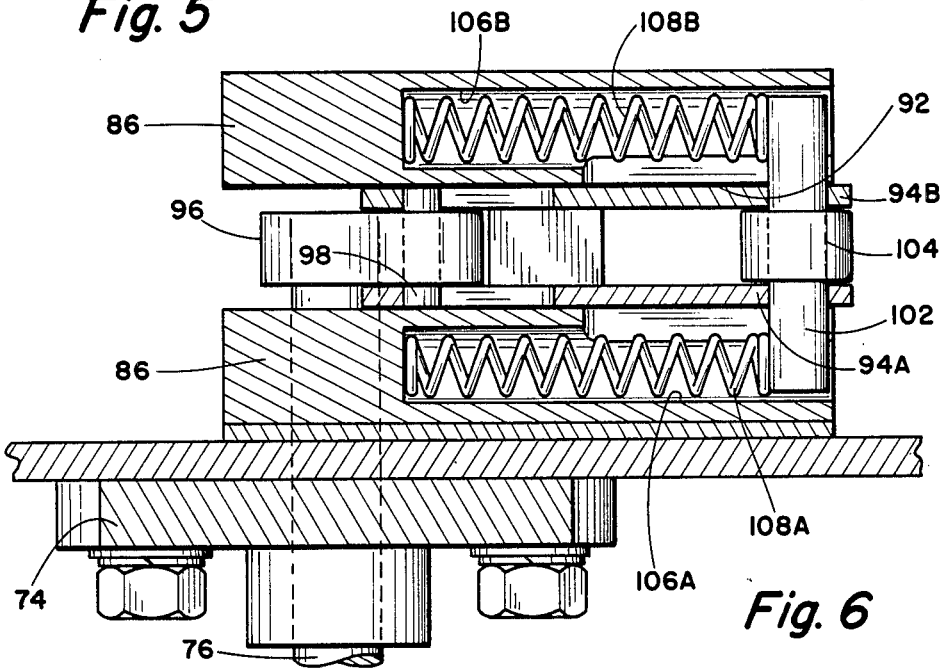
FIG. 6 is a cross-sectional view taken along the lines 6—6 of FIG. 5 of the latching mechanism.

The carriage block 86 has cylindrical recesses 106A and 106B (See FIG. 6) which are spaced from and parallel to slot 92. The cylindrical recesses receive springs 108A and 108B, the outer end of the springs engaging shaft 102. It can thus be seen that springs 108A and 108B bias the plunger 94 forwardly, that is, in the direction towards the energy storage mechanism 22.

Figure 8:
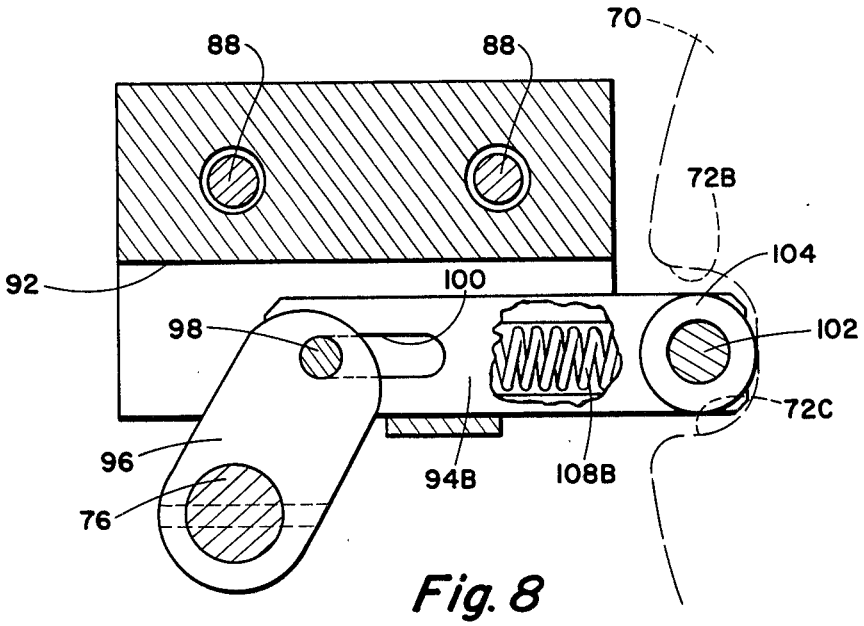
FIG. 8 is a cross-sectional view of the latching mechanism as taken along the line 8—8 of FIG. 7.
Figure 9:
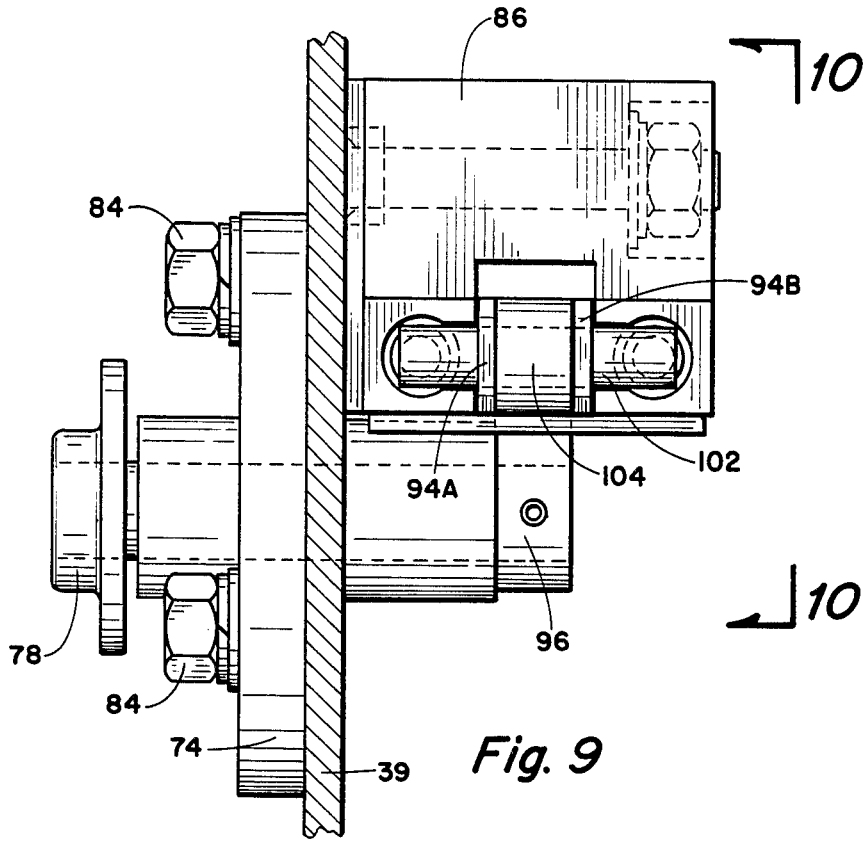
FIG. 9 is an end view of the switching mechanism as taken along the line 9—9 of FIG. 5 with the energy storage mechanism and cam plate not being shown.
Figure 10:
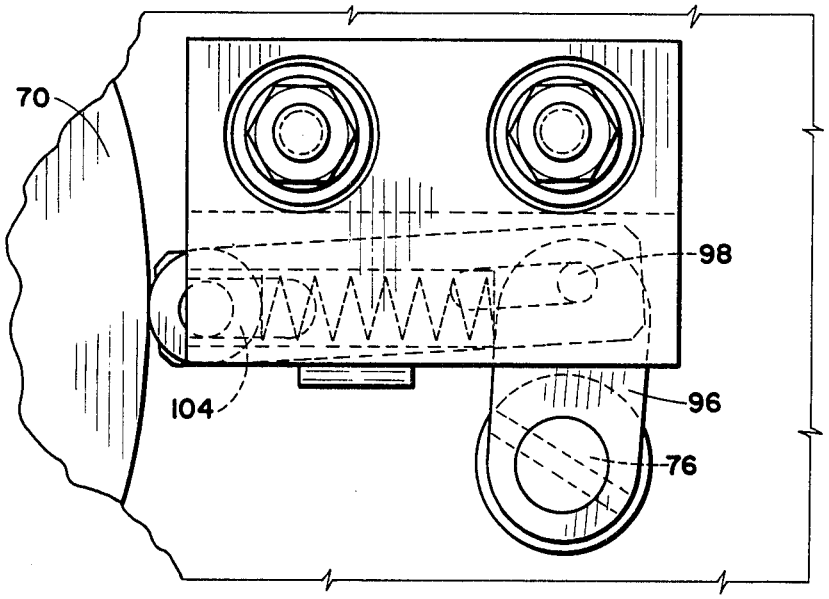
FIG. 10 is a rear view of the latching mechanism as taken along the line 10—10 of FIG. 9.

The roller 104 at the outer end of plunger 94A, 94B engages the edge of cam plate 70. As the cam plate moves relative to roller 104, springs 108A and 108B will cause the roller to enter into a notch area as shown in FIG. 8. With the roller engaging a notched surface on the cam plate, the stored energy mechanism 22 cannot be rotated, and thereby, the switch cannot be changed from one position to another.

Figure 11:
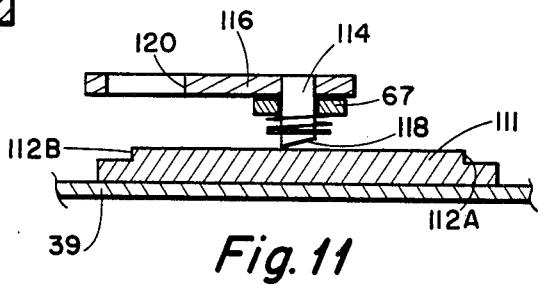
FIG. 11 is a cross-sectional view taken along the line 11—11 of FIG. 1 showing the cocking lever anti-reversing mechanism.
Figure 5:
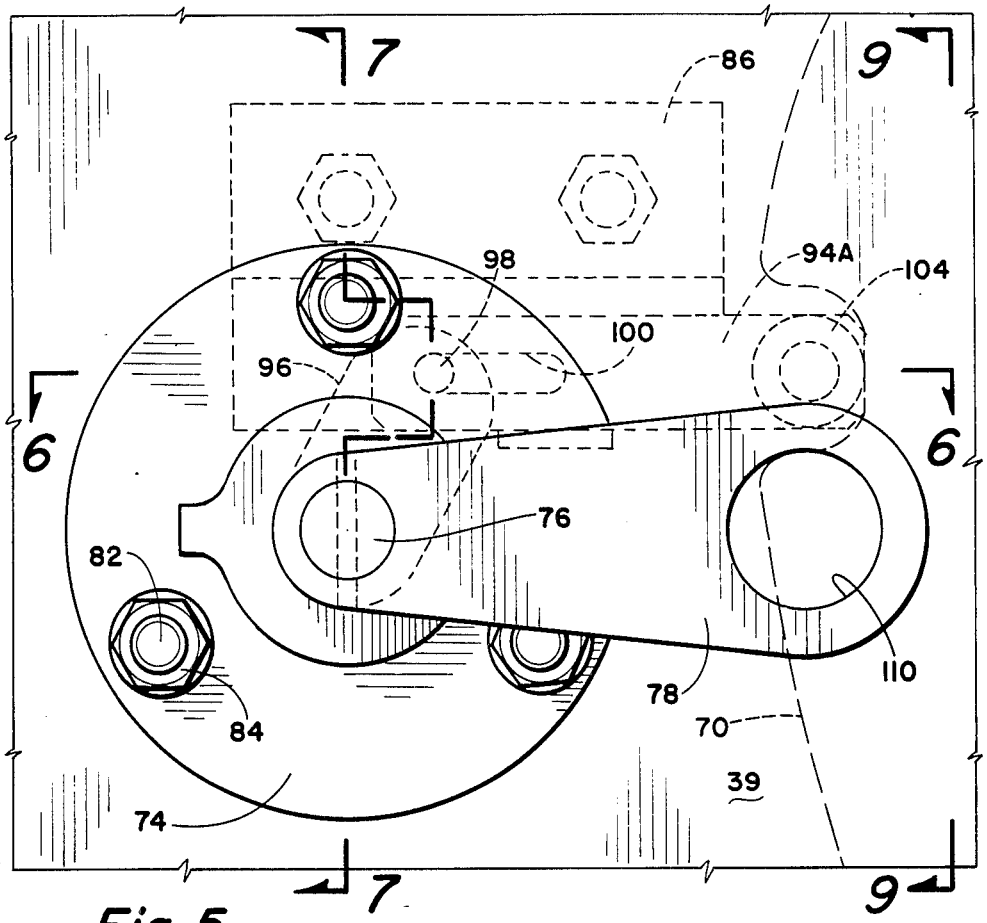
FIG. 5 is an enlarged front view of the latching mechanism, the portion behind the switch front cover being shown in dotted outline.

Referring to FIGS. 1 and 11, an anti-reversing mechanism is shown, a mechanism which, within itself is a known device as used on oil switches. Secured to the front cover plate 39 is a plate 111 which may be integral with hub 40 as seen in FIG. 3. The plate receives shaft 42 which supports handle 67. Formed on plate 111 is a raised cam surface 112 have end ledges 112A and 112B. Extending from handle 67 is a short anti-reversing pin 114 which receive reversing pointer 116. The pin has a lower inclined planar or cam surface 118. An opening 120 through pointer 116 provides an easy means for manually rotating the pointer in the direction handle 67 is to be moved.

The pointer 116 must be turned in the direction of rotation of handle 67. When the handle has been rotated to the position wherein the energy storage means is cocked, and cam surface 68 engages a dog 48 or 49, depending on the direction of rotation of the handle, the cam engaging surface will be positioned to, upon reversing the direction of rotation of the handle, to engage ledge 112A or 112B. Thus, handle 67 cannot be reversed until lever 116 is first reversed. In addition, the anti-reversing pointer 116 serves to hold the stored energy mechanism 22 in a charged condition after either dog 48 or 49 is tripped.

Method of Operation

The switch shown in FIG. 1, is in the OPEN position. It can be moved to the TEST or GROUND position by rotating the stored energy mechanism in the counterclockwise direction, that is, so that the switch blades 21 contact the contact members 27. The first step is rotation of the cocking lever 67 in the counterclockwise direction by the operator. This causes energy to be applied to springs 61 and 63, stretching them, while springs 60 and 62 are compressed and their inner ends slide in by means of pins 65. The energy storage mechanism cannot rotate for two reasons. First, latch dog 49 engages lug 58. Second, the trip plunger roller 104 is within the notch on cam plate 70 defined by surfaces 72B and 72C. As the operator continues to rotate lever 67, the spring arm 43 of cam surface 68 will ultimately engage pin 53, moving the latch dog 49 to the position shown in FIG. 4 wherein the energy mechanism would normally be released, causing the switch to be quickly rotated to the test or ground position. However, with the trip mechanism in position engaging notch surface 72B, this action cannot occur. The anti-reversing pin 114 prevents the stored energy mechanism from rotating in the opposite direction by the engagement of the pin cam surface 118 with the plate end ledge 112A. With the lever arm maintained in the position wherein the latching dog 49 is tripped, the mechanism is armed for movement between the switch OPEN position to the switch TEST position. This can be accomplished by rotation of the trip lever 78. The lever has an opening 110 so that a lanyard or short length or rope can be attached to it. In this manner the trip lever 78 may be rotated by a pull on such lanyard from a remote location. Upon rotation of the trip lever the plunger 94A,94B is withdrawn, allowing the stored energy mechanism to rotate.

It can be seen that when the switch is in the TEST position it can be cocked to be rotated to the OFF position by movement of arm 78 in the counterclockwise direction and from the OFF position can further be cocked for movement towards the closed position by again moving the cocking arm 67 in the clockwise direction. The switch may in this manner be cocked or armed to be moved from any one of its three positions; however, in each instance it will be necessary not only that the switch be cocked by rotation of lever 67 but that the trip lever 78 be subsequently actuated.

The invention thereby provides a switch mechanism which has a high degree of safety and yet this increased safety is accomplished by a mechanism which is susceptible of being constructed for long-lasting and dependable operation.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. A cock and trip switch actuating mechanism for operating a switch inside a housing wall, comprising:

an energy storage means rotatably mounted on a housing wall and having a plate rotatable about a plate shaft extending perpendicularly of the housing wall, the plate having spaced apart notches in a peripheral edge thereof;

a switch carriage means secured to and moved by said rotatable energy storage means between switch positions;

means of storing mechanical energy in said energy storage means tending to rotate said plate from an energy stored position to an energy released position;

a latching shaft rotatably mounted in the housing wall in juxtaposed position relative to said energy storage means, the latching shaft extending perpendicular to the housing wall;

a carriage block member affixed to the inner surface of said housing wall adjacent said latching shaft;

a plunger reciprocally supported by said carriage block member and extendable between a forward, locking position, and a rearward, unlocking position, the reciprocal axis of the plunger being coincident with a radius of said plate shaft;

a compression spring normally urging said plunger towards said plate;

means on the inner end of said plunger to be received within said notches in said plate peripheral edge;

a crank arm affixed at one end to said latching shaft, the other end being in pivotal engagement with said plunger; and means of rotating said latching shaft to permit said plate to rotate in response to energy stored in said energy storage means to thereby move said switch carriage means.

2. A cock and trip switch actuating mechanism according to claim 1 wherein said plunger has an elongated slot therein; and a pin extending from said crank arm other end and slideably received in said slot whereby said means on the inner end of said plunger can be received within a said notch on said plate without rotation of said latching shaft.

3. A cock and trip switch actuating mechanism according to claim 1 wherein said plate includes a cam member extending radially therefrom, the cam member having said notches therein.

4. A cock and trip switch actuating mechanism according to claim 1 wherein said housing wall has spaced apart openings therethrough and wherein said means of storing energy in said energy storage means includes a cocking shaft coaxial with said plate shaft about which said plate rotates, said cocking shaft extending through one of said wall openings, and including a cocking handle affixed to said cocking shaft for the manual rotation thereof, and wherein said latching shaft extends through the other of said openings in said wall, and including a trip lever affixed to said latching shaft, whereby said cocking handle and said trip lever may be operated from the same side of said wall.

5. A cock and trip switch actuating mechanism according to claim 1 wherein said energy storage means includes a pair of spaced plates and a cocking shaft extending therebetween and projecting outwardly therefrom, a switch handle arranged on said cocking shaft, a spring arm mounted on and rotatable by said cocking shaft, a series of springs connected to opposing ends of said spring arm, the outer ends of said springs being connected to pins slidably arranged in slots of said plates, said switch handle being rotated to move said switch carriage and to rotate said plates, whereby said springs will tend to move said switch carriage, said plates being prevented from rotation until said latching member shaft is rotated.

6. A cock and trip switch actuating mechanism according to claim 5 wherein said spring arm is connected to four springs connected to four pins slideably arranged in slots in said plates.

7. A cock and trip switch actuating mechanism according to claim 1 wherein said energy storage means includes a pair of spaced plates and a cocking shaft extending therebetween and projecting outwardly therefrom, a stationary lug on said housing wall, a pair of latching dogs pivoted at their opposite ends to one of said plates on either side of and engageable with said latching dogs for holding said energy storage means from movement until said latching dogs are released and for controlling movement in either direction, a switch handle arranged on said cocking shaft, a spring arm mounted on and rotatable by said cocking shaft, a series of springs connected to opposing ends of said spring arm, the outer ends of said springs being connected to pins slidably arranged in slots in one of said plates, said switch handle being rotated to move said switch carriage and to rotate said plates, spring arm and latching dogs therewith to release said latching dogs from said stationary lug, whereby at a predetermined position of said handle said spring arm will be released from said lug and said springs will tend to move said switch carriage, said plates being prevented from rotation until said latching member shaft is rotated.

8. A cock and trip switch actuating mechanism according to claim 7 wherein said spring arm is connected to four springs connected to four pins slideably arranged in slots in said plates.

9. A cock and trip switch actuating mechanism for operating a switch inside a housing wall, comprising:

an energy storage means rotatably mounted on a housing wall and having a plate rotatable about a plate shaft extending perpendicularly of the housing wall, the plate having spaced apart notches in a peripheral edge thereof;

a switch carriage means secured to and moved by said rotatable energy storage means between switch positions;

means of storing mechanical energy in said energy storage means tending to rotate said plate from an energy stored position to an energy released position;

a carriage block member affixed to the inner surface of said housing wall in juxtaposed position relative to said energy storage means;

a plunger reciprocally supported by said carriage block member and extendable between a forward, locking position, and a rearward, unlocking position, the reciprocal axis of the plunger being coincident with a radius of said plate shaft;

a compression spring normally urging said plunger towards said plate;

means on the inner end of said plunger to be received within said notches in said plate peripheral edge; and means operable to move said plunger from the forward locking position to the rearward unlocking position so as to permit said plate to rotate in response to energy stored in the energy storage means to thereby move said switch carriage means.

* * * * *